United States Patent [19]

Witney

[11] 4,062,545

[45] Dec. 13, 1977

[54] DOWNHILL SKI RACING GAME

[76] Inventor: Brian G. Witney, 6928 Bilbao Lane, Mississauga, Ontario, Canada

[21] Appl. No.: 706,483

[22] Filed: July 19, 1976

[51] Int. Cl.[2] ..... A63F 3/00

[52] U.S. Cl. ..... 273/134 AE; 273/134 C; 273/134 D; 273/134 CA; 273/134 G; 273/134 AT

[58] Field of Search ..... 273/134

[56] References Cited

U.S. PATENT DOCUMENTS 3,658,336 4/1972 Knapp ..... 273/134 AE

FOREIGN PATENT DOCUMENTS 1,010,035 3/1952 France ..... 273/134 GM

*Primary Examiner*—Delbert B. Lowe

[57] ABSTRACT

A downhill ski racing game includes a playing board having a three-dimensional upper portion, wherein a ski route having a pair of paths is disposed on the upper surface of the upper portion, wherein each path is formed from a plurality of contiguous squares. A pair of dice are provided as well as chance cards for determining the number of contiguous squares to move each playing piece. Mishap cards are also provided and can cancel a player's turn or remove him from play. A mechanism is provided for sloping and maintaining the playing board upwardly from the ground.

7 Claims, 4 Drawing Figures

DOWNHILL SKI RACING GAME

BACKGROUND OF THE INVENTION

A number of U.S. Patents relate to board games for sports. These patents are U.S. Pat. No. 2,823,919 to Scruggs; U.S. Pat. No. 3,045,393 to Knott; U.S. Pat. No. 3,462,152 to Rayston; and U.S. Pat. No. 3,658,336 to Knapp. These aforementioned patents are non-applicable to my present invention.

SUMMARY OF THE INVENTION

My present invention relates to a unique and novel game for a downhill ski race.

An object of my present invention is to provide a game, wherein a downhill ski race is played by a plurality of players.

A still further object of my present inventin is to provide a plurality of routes for each player to select in order to reach the finish line.

A still further object of my present invention is to provide a unique and novel set of dice for determining the number of squares to move each playing piece.

Another object of my present invention is to provide a means for sloping the playing board upwardly from the ground.

Briefly, my present invention comprises a playing board having a three-dimensional upper portion, wherein a plurality of ski routes are disposed on the upper surface of the upper portion, wherein each route is formed from a plurality of contiguous squares. A pair of dice are provided as well as chance cards for determining the number of contiguous squares to move each playing piece. Mishap cards are also provided and can cancel a player's turn or remove him from play. A mechanism is provided for sloping and maintaining the playing board upwardly from the ground.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
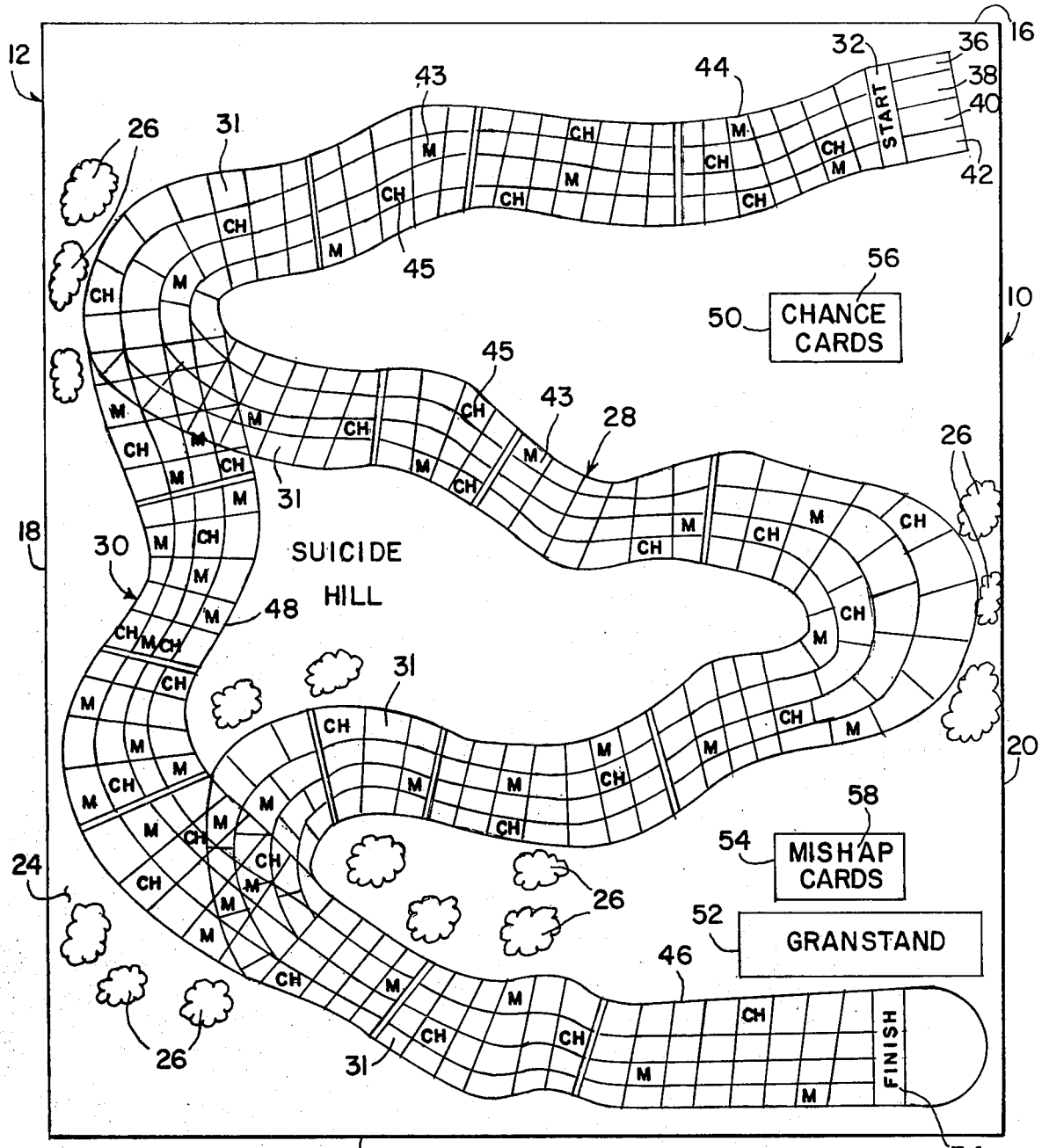
FIG. 1 illustrates a top planar view of a playing board for a downhill ski racing game.
Figure 2:
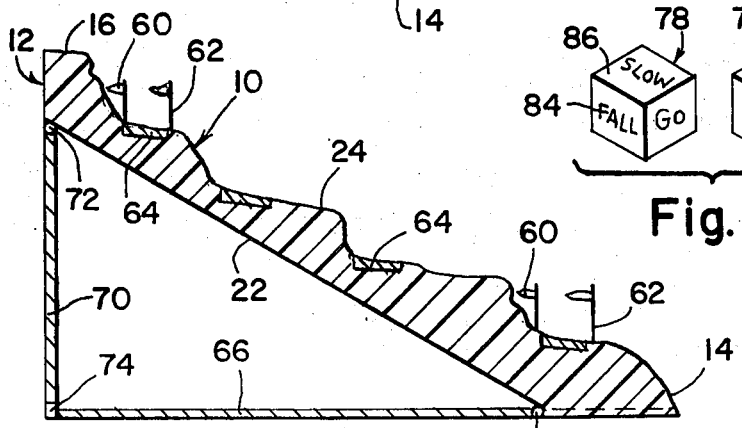
FIG. 2 illustrates a side cross-sectional view of the playing board.

Turning now descriptively to the drawings, in which similar reference characters denote similar elements throughout the several views, FIGS. 1-2 show a playboard 10 for a ski downhill race game. The playboard 10 generally comprises a rectangularly shaped board member 12 having a lower end 14, an upper end 16, a pair of sides 18, 20, a planar bottom surface 22, and a three-dimensional upper portion 24 depicting hills, valleys and ridges with trees 26 printed thereon. The board member 12 is ideally formed from a thermoplastic resin by a vacuum molded process. A ski route comprising two paths 28, 30 are disposed on the upper surface of the upper portion 24. The first path 28 is of a generally W shaped configuration representative of a typical ski run and is formed from a plurality of contiguous playing squares 31, wherein there is a starting square 32 and a finish square 34. The path 28 is subdivided into four lanes 36, 38, 40, 42, wherein the lanes are in parallel alignment next to each other and each lane 36, 38, 40, 42 has the same number of squares 31 including the start 32 and finish 34 squares. The start 32 and finish 34 squares are disposed at the outer ends of the legs 44, 46 of the W-shaped configuration. A plurality of squares 31 at 43 path 28 are marked M representative of mishap and other squares 31 at 45 are marked COH representative of chance. The second path 30 is shorter than the first path 28 and is called the suicide path because of its degree of difficulty. The second path 30 is generally U shaped, wherein the legs of the U shape are common to the legs 44,46 of the W-shaped configuration. The second path 30 has the playing squares 31, the four lanes 36, 38, 40, 42, the same start 32 and finish 34 squares as well as mishap squares 43 and chance squares 45. The degree of difficulty of second path 30 is realized by having an excessive amount of mishap squares 45 along the base 48 of the U shaped configuration. The upper surface 24 has three rectangularly shaped boxes 50, 52, 54 printed thereon. The first box 50 disposed near the starting squares 32 receives a plurality of chance cards 56 thereon. The second box 52 has the name "Grandstand" printed therein. The third box 54 receives a plurality of mishap cards 58 thereon. Ornamental ski flags 60 on poles 62 are disposed along each route 28, 30. Each playing square 31 has a thin magnetic strip 64 adhesively secured thereon. The board member 12 is sloped upwardly from the ground, wherein the lower end 14 engages the ground and the upper end 16 is raised up from the ground. A first leg member 66 is joined by a first hinge means 68 to the lower end 14 of the board member 12. A second leg member 70 is joined by a second hinge means 72 to the upper end 16 of the board member 12. In use, leg member 66 rests horizontally on the ground and leg member 70 extends vertically downward to meet leg member 66 at its outer end, wherein a latch means 74 locks the leg members 66, 70 together. The plurality of mishap cards 58 have messages printed thereon such as (a) you fell, lose two turns; (b) your boots are loose, miss three turns; and (c) you broke your leg, you are out of the race. The plurality of chance cards 56 have good and bad messages printed thereon such as (a) take extra roll of dice; (b) go ahead one square; and (c) go back one square.

Figure 3:
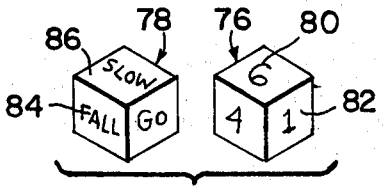
FIG. 3 illustrates a perspective view of a pair of dice used in the game.

FIG. 3 shows a pair of dice 76, 78 used in playing the game. The first die 76 has numbers 80 one through six printed on its six sides 82. The second die 78 has printed a different word 84 on each ot its six sides 86, wherein the words 84 are "go", "mishap", "fast", "slow", "fall", and "chance".

Figure 4:
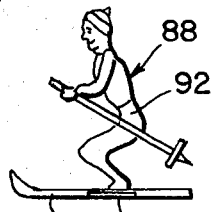
FIG. 4 illustrates a side view of a playing piece of the game.

FIG. 4 shows one of four playing pieces 88, wherein each piece 88 is color coded differently corresponding to the different color of each lane 36, 38, 40, 42. Each piece 88 includes a metallic base 90 having a crouched figure 92 disposed thereon with a pair of skis 94.

The game is played as follows with two to four players, wherein the object is to cross the finish line first with your playing piece 88. Each player picks a playing piece and places it in one of the correspondingly color coded lanes 36, 38, 40, 42. The player can select either path 28 or 30 to reach the finish square at 34. If the player lands on an M square 43, he picks a mishap card 58 and if he lands on a CH square at 45 he picks a chance card 56. In order to determine the number of squares 31 to move, the player rolls the dice 76, 78. The first die 76 tells the player the number of squares 31 to move by the rolled number 80 on the die 76. The second die 78 tells the player if he should use the number directly on die 76 or multiply or divide the number 80 of die 76 to determine the number of squares 31 to move. If the word slow is rolled the number 80 on die 76 is divided by two. If the word go is rolled the number 80 is used as is. If the word mishap or chance is rolled the number 80 is used as is and the respective mishap card 58 or chance card 56 is picked. If the word fall is rolled, the player loses his turn. If the word fast is rolled, the number 80 is doubled.

I claim

1. A board game for downhill ski racing comprising:

a playing board having a three-dimensional upper portion;

a ski route disposed on the upper surface of said three-dimensional portion, said ski route formed from a plurality of contiguous squares having start and finish squares said ski route including a pair of alternate paths of different lengths intermediate said start and finish squares;

a plurality of playing pieces each being moveable along and securable to said ski route;

means for determining the number of said contiguous squares to move each said playing piece on said route during the play of said game;

a plurality of mishap cards selected upon the landing of one of said playing pieces on a contiguous square having suitable indicia directing the selection of a mishap card; and a plurality of chance cards selected upon the landing of one of said playing pieces on a contiguous square having suitable indicia directing the selection of a chance card, the shorter of said two paths having a greater number of contiguous squares bearing said mishap suitable indicia than the longer of said two paths.

2. A board game in accordance with claim 1, further comprising means for sloping and maintaining said playing board upwardly from a supporting surface.

3. A board game in accordance with claim 2, wherein said sloping and maintaining means comprises a first leg member hingeably joined to a lower edge of the playing board and a second leg member hingeably joined to an upper edge of said playing board, the outer ends of said first and second leg members joined perpendicularly, said first leg member adapted to engage said supporting surface.

4. A board game in accordance with claim 1, wherein said determining means comprise a pair of dice, one of said dice having numbers disposed thereon, the other of said dice having instructional movement words disposed thereon, a combination of said numbers and said words as dictated by preselected playing rules determining the number of said squares to move each of said playing pieces.

5. A board game in accordance with claim 1, wherein each of said paths is divided into a plurality of lanes.

6. A board game in accordance with claim 1, wherein each of said playing pieces comprises a base and a figure disposed on said base.

7. A board game in accordance with claim 6, further comprising a plurality of magnetic strips disposed along said route, said bases being magnetic and selectively engaging said strips.

* * * * *